US011604050B2

(12) United States Patent
Pirkle et al.

(10) Patent No.: US 11,604,050 B2
(45) Date of Patent: Mar. 14, 2023

(54) METHOD FOR ACOUSTICALLY COUNTING GUNSHOTS FIRED INDOORS

(71) Applicant: Tyco Fire & Security GmbH, Neuhausen am Rheinfall (CH)

(72) Inventors: Wesley C. Pirkle, New Albany, OH (US); Richard L. Shoaf, Westerville, OH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 463 days.

(21) Appl. No.: 16/328,093

(22) PCT Filed: Aug. 15, 2017

(86) PCT No.: PCT/US2017/046952
§ 371 (c)(1),
(2) Date: Feb. 25, 2019

(87) PCT Pub. No.: WO2018/044556
PCT Pub. Date: Mar. 8, 2018

(65) Prior Publication Data

US 2019/0186875 A1 Jun. 20, 2019

Related U.S. Application Data

(60) Provisional application No. 62/380,707, filed on Aug. 29, 2016.

(51) Int. Cl.

| | |
|---|---|
| ***F41J 5/06*** | (2006.01) |
| ***F41A 19/01*** | (2006.01) |
| ***G08B 13/16*** | (2006.01) |

(52) U.S. Cl.
CPC ..... *F41J 5/06* (2013.01); *F41A 19/01* (2013.01); *G08B 13/1672* (2013.01)

(58) Field of Classification Search
CPC ..... F41J 5/06; G08B 13/1672; F41A 19/01
USPC ..... 367/124
See application file for complete search history.

(56) References Cited

U.S. PATENT DOCUMENTS

| | | | |
|---|---|---|---|
| 5,455,868 | A | 10/1995 | Sergent et al. |
| 5,917,775 | A | 6/1999 | Salisbury |
| 6,185,153 | B1 | 2/2001 | Hynes et al. |
| 2005/0237186 | A1 | 10/2005 | Fisher et al. |
| 2016/0209390 | A1 | 7/2016 | Overcast |

OTHER PUBLICATIONS

International Preliminary Report on Patentability, dated Mar. 14, 2019, from International Application No. PCT/US2017/046952, filed on Aug. 15, 2017. 6 pages.

(Continued)

*Primary Examiner* — Daniel L Murphy
(74) *Attorney, Agent, or Firm* — HoustonHogle LLP

(57) ABSTRACT

After determining that a gunshot has been fired, particularly indoors, the method of the invention is employed to determining the number of gunshots fired by analyzing consecutive windows of time over a certain time period. That is, after it is determined that a gun has been fired, the method is employed to identify that the gun is an automatic or rapid fire weapon by quickly counting the number of rounds shot over short periods of time. This information can be used to provide shooting details, both in connection with notifying emergency personnel and enabling the personnel to assess details of the shooting incident.

21 Claims, 2 Drawing Sheets

(56) References Cited

OTHER PUBLICATIONS

International Search Report and Written Opinion, dated Nov. 6, 2017, from International Application No. PCT/US2017/046952, filed on Aug. 15, 2017. 7 pages.
Tolonen, T. et al. "A Computationally Efficient Multipitch Analysis Model." IEEE Transactions on Speech and Audio Processing, vol. 8, No. 6, Nov. 2000. 9 pages.

METHOD FOR ACOUSTICALLY COUNTING GUNSHOTS FIRED INDOORS

BACKGROUND OF THE INVENTION

RELATED APPLICATIONS

This application is a § 371 National Phase Application of International Application No. PCT/US2017/046952, filed on Aug. 15, 2017, now International Publication No. WO 2018/044556, published on Mar. 8, 2018, which International Application claims the benefit under 35 USC 119(e) of U.S. Provisional Application No. 62/380,707, filed on Aug. 29, 2016, both of which are incorporated herein by reference in their entirety.

Field of the Invention

The present invention pertains to the art of acoustics and, more particularly, to a method employing acoustics in connection with counting the number of gunshots shot indoors.

Discussion of the Prior Art

The broad concept of detecting gunshots utilizing acoustics is known. More specifically, it is known to provide a gunshot detecting system including an array of acoustic sensors positioned in a pattern which enables signals from the sensors to be employed to not only detect the firing of a gunshot but to also locate the origin of the shot. One main requirement of such a system is the need to accurately distinguish between the sound produced from a gunshot and a host of other ambient sounds. In at least one known arrangement, a microphone is used to detect each sound, which is then amplified, converted to an electrical signal and then the electrical signal is compared with a threshold value above which a gunshot sound is expected to exceed.

Regardless of known arrangements in this field which can detect a gunshot, there is still seen to exist a need for an acoustic gunshot detection method which can count the number of gunshots fired, particularly from an automatic or fast acting weapon.

SUMMARY OF THE INVENTION

The present invention is directed to a method for counting gunshots fired from a weapon, particularly an automatic or fast acting weapon, e.g., a weapon which can be shot multiple times in less than a 0.3 second interval. More specifically, the method is concerned with, after determining the firing of a gunshot indoors in a certain interval, determining the number of gunshots fired by analyzing consecutive windows of time over the certain interval. The method relies on the acoustic signature of the noise as collected, with the acoustic signature being analyzed to accurately count how many shots are fired. That is, after it is determined that a gun has been fired, the method is employed to identify that the gun is an automatic or rapid fire weapon by quickly counting the number of rounds shot over short periods of time. This information can be used to provide shooting details, both in connection with notifying emergency personnel and enabling the personnel to assess details of the shooting incident.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
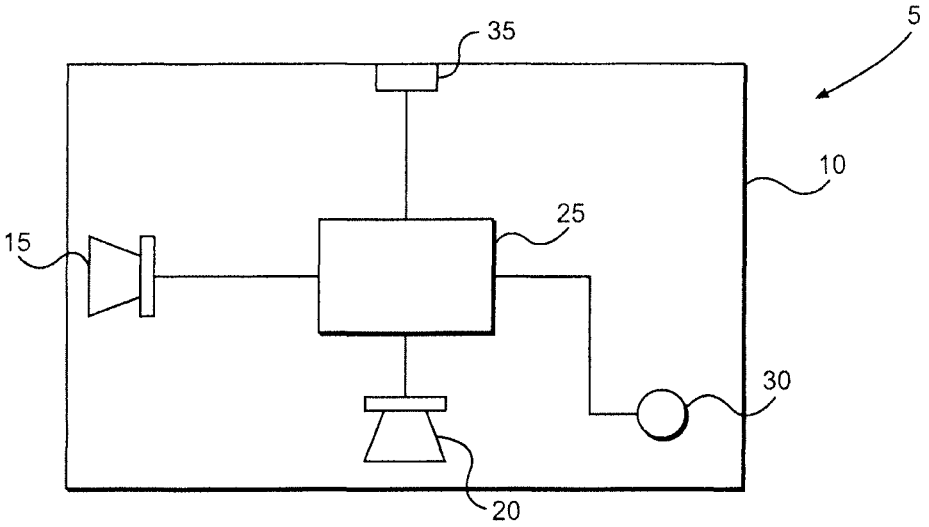
FIG. 1 schematically indicates sensor structure associated with the invention.

Prior to detailing the manner in which gunshots are counted in accordance with specifics of the invention, for the sake of completeness, a preferred manner in which a sound in a building or other structure is sensed and determined to be a gunshot will first be described. With initial reference to FIG. 1, a gunshot detection sensor designed for mounting within a building or structure to be monitored for gunshots is generally indicated at 5. In the embodiment shown, sensor 5 includes a single computer board 10 linked to a first microphone 15 and a second microphone 20. As depicted, first and second microphones 15 and 20 are preferably arranged orthogonal to each other and connected to a CPU 25 (particularly a multi-core processor for fast signal processing) which is electrically powered, such as through a 5V battery 30, a micro USB port or the like. Also provided as part of sensor 5 is a network connector, such as an Ethernet, USB or the like connection port indicated at 35. At this point, it should be noted that sensor 5 can actually take on various forms while functioning and operating in the manner which will be detailed below. Certainly, it should be recognized that sensor 5 could be electrically powered in various ways, including being electrically hardwired, and need. not be network hardwired but rather can incorporate a wireless interface. In general, it is important that CPU 25 is capable of sampling acoustic signals received from both microphones 15 and 20, specifically at a tninimum of 192 kHz.

In the most preferred form of the invention, each microphone 15, 20 constitutes a MEMS microphone which is omnidirectional. In accordance with the invention, one microphone 15 has a low sensitivity while the other microphone 20 is more sensitive. In accordance with the invention, a low sensitivity is defined as below −40 dBFS while, by "more sensitive" it is meant that microphone 20 has a sensitivity which is at least 70% greater than the sensitivity of the "low sensitivity" microphone 15. In an exemplary embodiment, microphone 15 has a low sensitivity of −46 dBFS, but with a high clipping level, specifically greater than 130 dB. On the other hand, microphone 20 has a sensitivity of −26 dBFS. Although various known microphones could be employed in connection with the invention, in one specific embodiment, currently available MEMS microphone models INMP621ACEZ-R7 and MP34DBO1TR which are digital, 16 bit microphones manufactured by InvenSense, Inc. are utilized for the first and second microphones 15 and 20 respectively.

In general, the system and method operates by initially identifying an incoming acoustic signal which could potentially be from a gunshot. For this purpose, only outputs from microphone 15 are initially, continuously analyzed for a peak amplitude level large enough to he preliminarily identified as a gunshot. Basically, since microphone 15 has a low sensitivity, microphone 15 only provides an output for very loud sounds and is essentially deaf to normal, everyday sounds emanating from within the building or structure and therefore will likely not reach a necessary threshold on any noise other than the loudest sounds. By way of example, a typical trigger value would be −5 dBFS (corresponding to a digital value of approximately 18000 based on the 16 hit unit). After a possible gunshot is identified in this manner, the system then processes acoustic signals to determine if the sound was actually from a gunshot in the manner detailed below.

Figure 2:
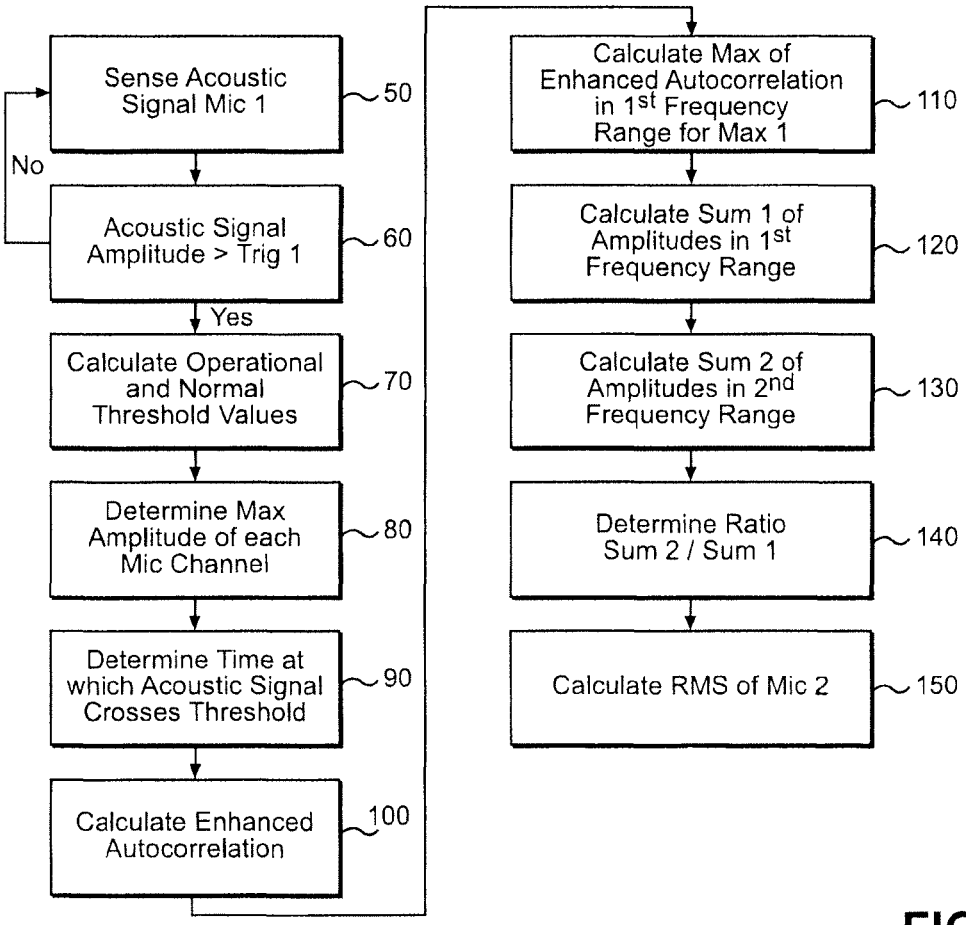
FIG. 2 is a flowchart of a calculation algorithm which can be employed to detect a gunshot in connection with the invention.

Reference will now be made to FIG. 2 in describing a preferred methodology employed in accordance with the invention. Here, it can be seen that steps 50 and 60 represent the initial possible gunshot identification routine outlined above which utilizes outputs from first microphone 15 and compares peak signal amplitudes with a pre-established trigger value, e.g., 18000. Assuming that a possible gunshot sound has been identified, step 70 is reached in which operational and nominal threshold values are established for upcoming calculations. At this point, it should be noted that these threshold values can actually be preset based on at least the acoustic characteristics of the particular building or structure in which sensor 5 is employed. However, for at least versatility reasons, it is desirable to enable these threshold values to be adjustable, such as based on changing acoustic characteristics or sensor layout. In addition to the trigger threshold, other established threshold values include: a Mic 1 threshold (TH_1), a Mic2 root-mean-square (RMS) threshold (RMS_2_Thresh), a time window (Win_1), an enhanced autocorrelation window (EnAuto_Win_1) an enhanced autocorrelation threshold for an established frequency range between 15 kHz and 25 kHz (EnAuto_15_25_Thresh_1) and a maximum enhanced autocorrelation threshold for the established frequency range (EA_Max_15_25_TH). By way of example, the following nominal threshold values can be employed: Trig_1=18000; TH_1=5000; RMS_2_Thresh=−13 dBFS (or an equivalent digital output of 7336); Win_1=0.30 seconds; EnAuto_Win_1=0.075 seconds; EnAuto_15_25_Thresh_1=1.25; and EA_Max_15_25_TH=325.

With these nominal threshold values being established, step 80 is entered wherein the maximum amplitude for each of microphones 15 and 20 is determined (Max_1 and Max_2). Next, the time at which the acoustic signal crosses the threshold is determined in step 90. Basically, there is a time lapse between first microphone 15 sensing the sound and outputting the signal which has been identified as a potential gunshot. Here, it is desired to determine time zero (T_Win_1) for the potential shot and use this time for future calculations. Although other formulations could be employed, for purposes of a preferred embodiment of the invention, T_Win_1 is set equal to the time at which the first microphone amplitude exceeds TH_1 minus a predetermined time period, preferably 10 ms, wherein T_Win1 is required to be less than Win_1, i.e., 0.3 seconds, from the point at which the amplitude is greater than Trig_1. This same calculated time zero is also used in connection with second microphone 20 (T_Win_2=T_Win_1).

Next, step 100 is entered wherein an enhanced autocorrelation is calculated. At this point, it should be recognized that enhanced autocorrelation is known based on harmonics. Here, a known method is employed to filter data by determining pitches based on frequencies. As enhanced autocorrelation methods are known, further details will not be provided here. By way of example, reference is simply made to the article "A Computationally Efficient Multipitch Analysis Model" by Tolonen et al., IEEE Transactions on Speech and Audio Processing, Vol. 8, No. 6, (November 2000), the contents of which are fully incorporated herein by reference. With the invention, the preset operational enhanced correlation window (EnAuto_Win_1) is employed.

In step 110, a maximum value of the enhanced auto correlation is determined. For this purpose, values in a first frequency range or band between 15 kHz and 25 kHz are relied upon for microphone 15. Here, the process is looking to establish a peak in this frequency range (EA_Max_15_25_1). Next, all amplitudes in a slightly larger, second frequency range, preferably 10 kHz to 25 kHz, are summed in step 120 (EA_10_25_Sum_1). Thereafter, all amplitudes in a third, distinct frequency range, preferably frequency bands between 2 kHz to 5.5 kHz, are summed in step 130 (EA_2_55_Sum_1). These two summation steps in distinct ranges are performed in connection with avoiding a false positive identification based on knowing that sounds from a gunshot have a broad range as compared to many other potentially sensed sounds.

With all the above calculations, the algorithm moves to step 140 wherein a ratio of the summation values determined in steps 130 and 120 is determined, i.e., Ratio_EA_1=EA_2_55_Sum_1/EA_10_25_Sum_1. In this step, the denominator cannot equal zero. Therefore, if EA_10_25_Sum_1 equals zero, the Ratio_EA_1 is set to a predetermined value, such as 3.0. Finally, in step 150, the RMS of microphone 20 is calculated. More specifically, the RMS of microphone 20 (RMS_Full_2) is calculated using Win_1 and starting at T_Win_2. Basically, these steps are performed to see how the sound dissipates over a relatively short period of time, say 0.3 seconds, for microphone 20. Here it should be noted that the sound associated with a gunshot takes a fair amount of time to dissipate versus, say, tapping a microphone. Therefore, it can be verified here that the RMS stays high for a requisite period of time. Additionally, it should be recognized that signals from microphone 20 can be used for further verification, e.g., sensing sounds of screaming versus laughter or minor chatter.

Figure 3:
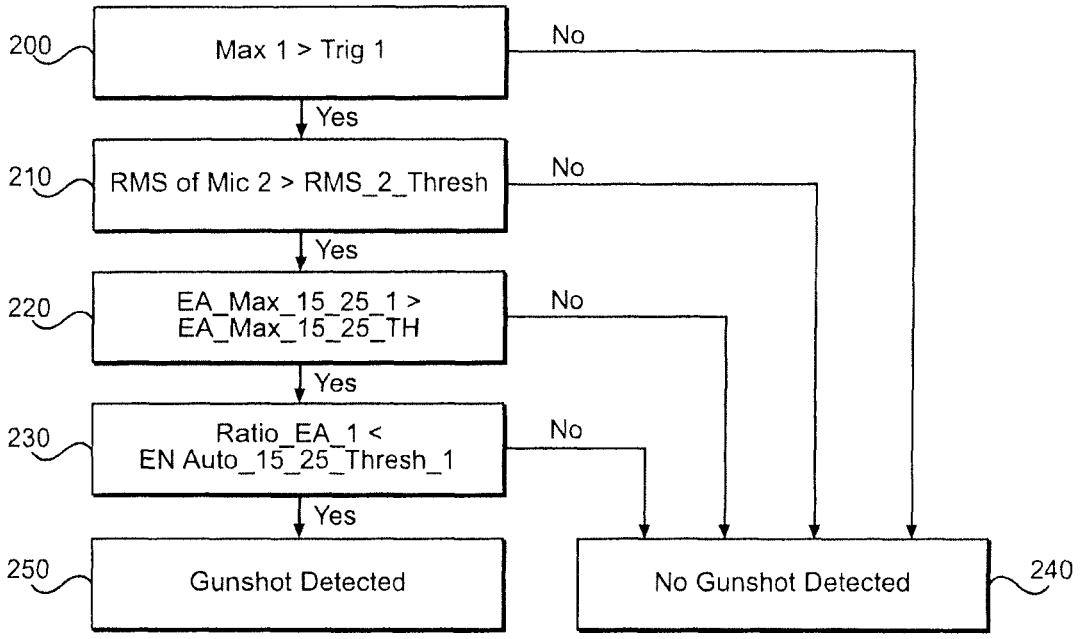
FIG. 3 is a flowchart of a comparing algorithm for use with the invention.

Once the calculations associated with the FIG. 2 algorithm are performed, it can then be determined if the detected sounds were actually from a gunshot. In accordance with a preferred embodiment of the invention as represented in FIG. 3, it is only determined that a gunshot has been detected if multiple requirements are satisfied, i.e., each of the requirements of steps 200, 210, 220 and 230 are satisfied. Specifically, to move past step 200, it must be determined that the maximum amplitude sensed by microphone 15 is greater than the trigger value (Max_1>Trig_1). Of course, this is just a verification step based on the requirements of step 60. In addition, RMS_Full_2>RMS_2_Thresh (step 210), EA_Max_15_25_1>EA_Max_15_25_TH (step 220), and Ratio_EA_1<EnAuto_15_25_Thresh_1 (step 230). If any one of these determinations cannot be made, it is determined that a gunshot has not been detected (step 240). On the other hand, if all of these verification steps are satisfied, step 250 is reached to verify that an actual gunshot has been sensed. If a gunshot is detected at 250, this is signaled via port 35 to a networked computer that can be used for alert purposes, such as alerting emergency personnel, such as building or local jurisdictional personnel) of the occurrence of the gunshot and, based on the particular sensor used in making the determination, the location of the gunshot.

Figure 4:
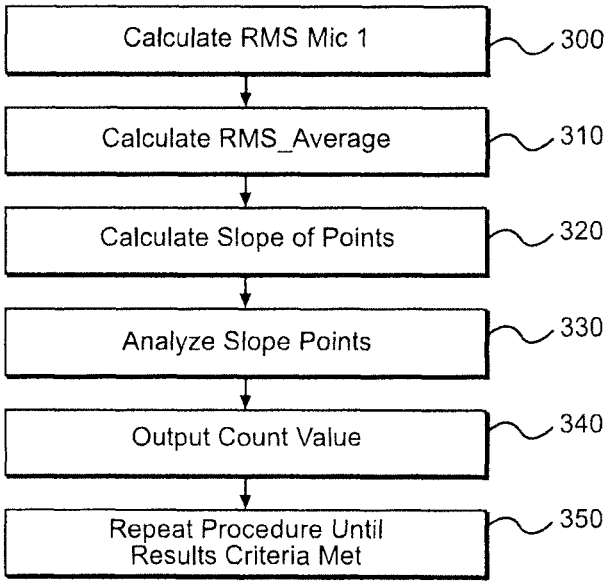
FIG. 4 is a flowchart showing the manner in which gunshots are counted in accordance with the invention.

As emphasized, the above described system and method are employed to determine that a detected sound actually does stem from a gunshot. With this as a backdrop, the present invention is particularly directed to using the acoustic signature of a gunshot and at least one of microphones 15 and 20 to actually count the number of gunshots fired, such as through rapid fire or from an automatic weapon. Initially, it should be noted that the above-described algorithms are not fully needed to identify each shot or to count the number of shots in accordance with this invention. Instead, the above algorithms are employed to detect a gunshot in a time period over which multiple gunshots could have actually occurred. Therefore, the present invention is particularly concerned with studying that same time period, but in much smaller increments and determining the actual count of gunshots throughout the time period, then repeating this process over an even larger period to establish the overall number or count of gunshots. In connection with the invention, some of the calculated, operational and nominal threshold values determined above are employed, along with some additional threshold values (including an RMS_1) as detailed below with specific reference to FIG. 4.

Again, it is assumed that the occurrence of a shot has already occurred and it is now desired to count the number of shots. At step 300, the RMS (root-mean-square) value of microphone 15 is calculated using T_Win_1 and RMS_1. Here, RMS_1 represents the window or region over which RMS values are calculated which, in a preferred embodiment, is set at 10 ms. Therefore, where the algorithms above are based on a 0.3 second window in determining an occurrence of a gunshot, here 10 ms increments or intervals of time from T_Win_1 are analyzed in connection with counting the number of gunshots. In step 310, an average RMS is calculated by averaging multiple RMS values or points, preferably every 3 RMS points, together (RMS_Average=Average 3 points together, i.e., points 1-3, 2-4, 3-5, etc.). At step 320, the slope of consecutive points is calculated, with the slope reflecting the rate at which the RMS is changing, while also indicating the onset and falling off of a gunshot. Thereafter, if it is determined that 3 or more consecutive slope points are greater than 0 (consecutive positive slope points) and a maximum RMS value is greater than 400, then a shot count is established at step 330 and the shot count is output at step 340. The overall procedure continues until the RMS value (here the 10 ms RMS) drops below TH_1 (e.g. 5000) or ⅓ of the RMS_Average for microphone 15 (from step 300) as indicated at step 350. If step 350 is reached, the number of counts for the established interval has been determined, then, after a 10 ms delay, the entire algorithm is repeated for the next time interval. This overall process continues until the entire period or window is analyzed, resulting in a total number of shots fired inside the building in the overall time period. This count is preferably conveyed or outputted to emergency personnel for alerting or investigative purposes.

Although described with reference to preferred embodiments, it should be understood that various changes and/or modifications can be made to the invention without departing from the spirit thereof. Instead, the invention is only intended to be limited by the scope of the following claims.

The invention claimed is:

1. A method of acoustically counting a number of fired gunshots comprising the steps of:

a) determining a RMS value of signals from a microphone over a predetermined time period;

b) averaging multiple RMS values together to establish an average RMS value;

c) calculate a slope of consecutive RMS values; and d) determining a shot count based on results of steps a)-c).

2. The method of claim 1, wherein step b) constitutes averaging three RMS values together.

3. The method of claim 1, further comprising: after performing step c), determining if 3 or more consecutive slope values are greater than zero before moving to step d).

4. The method of claim 1, further comprising: determining if a maximum RMS value is greater than a predetermined value before moving to step d).

5. The method of claim 4, wherein the predetermined value is 400.

6. The method of claim 4, further comprising: if the slope in step c) drops negative, restart the count.

7. The method of claim 1, further comprising:

after performing step c), determining if 3 or more consecutive slope values are greater than zero or determining if a maximum RMS value is greater than a predetermined value, before moving to step d).

8. The method of claim 1, further comprising: continuing the method until the RMS value drops below 5000.

9. The method of claim 1, further comprising: if the average RMS value drops below ⅓ of the average RMS value, pause a predetermined time period and then proceed back to step a).

10. The method of claim 9, wherein the predetermined time period is 10 ms.

11. The method of claim 1, further comprising: outputting a shot count indicating the number of fired gunshots.

12. The method of claim 1, further comprising: alerting emergency personnel of the number of fired gunshots.

13. The method of claim 1, wherein the method is performed in acoustically counting the number of fired gunshots within a building.

14. The method of claim 1, wherein the microphone has a low sensitivity.

15. A method of acoustically counting a number of fired gunshots comprising:

a) determining RMS values of signals from a microphone over a predetermined time period;

b) averaging multiple RMS values together to establish average RMS values;

c) calculating slope values of consecutive RMS values;

d) determining an existence of a gunshot within the predetermined time period when 3 or more consecutive slope values are greater than zero; and e) determining a shot count based on results of steps a)-c) repeated for subsequent time intervals until the entire window has been analyzed.

16. The method of claim 15, wherein step b) constitutes averaging three RMS values together.

17. The method of claim 16, wherein the predetermined value is 400.

18. The method of claim 15 further comprising:

determining if a maximum RMS value is greater than a predetermined value in step d).

19. The method of claim 15, further comprising: if the slope in step c) drops negative, restart the count.

20. The method of claim 15, further comprising: if the average RMS value drops below ⅓ of the average RMS value, pause a wait time period and then proceed back to step a).

21. A method of acoustically counting a number of fired gunshots comprising:

a gunshot counting process executing on a processor of a gunshot detection sensor mounted within a structure to be monitored for gunshots performing steps a) through f) as follows, wherein the gunshot detection sensor comprises a computer board linked to a microphone and connected to the processor, which is an electrically powered multi-core processor capable of sampling acoustic signals received from the microphone at a minimum of 192 kHz:

a) determining RMS values of signals from the microphone over a predetermined time period, wherein the microphone is a MEMS microphone having a sensitivity below −40 dBFS;

b) averaging multiple RMS values together to establish average RMS values;

c) calculating slope values of consecutive RMS values;

d) determining an existence of a gunshot within the predetermined time period when 3 or more consecutive slope values are greater than zero;

e) determining a shot count based on results of steps a)-c) repeated for subsequent time intervals until an entire window has been analyzed; and f) outputting the shot count indicating the number of fired gunshots and/or alerting emergency personnel of the shot count.

* * * * *